US007941989B2

(12) United States Patent
Morsching

(10) Patent No.: US 7,941,989 B2
(45) Date of Patent: May 17, 2011

(54) DECK FLASHING TRIM SYSTEM

(75) Inventor: Mark William Morsching, Maplewood, MN (US)

(73) Assignee: Everflash, LLC, Maplewood, MN (US)

( * ) Notice: Subject to any disclaimer, the term of this patent is extended or adjusted under 35 U.S.C. 154(b) by 0 days.

(21) Appl. No.: 12/204,424

(22) Filed: Sep. 4, 2008

(65) Prior Publication Data

US 2009/0056235 A1 Mar. 5, 2009

Related U.S. Application Data

(60) Provisional application No. 60/967,251, filed on Sep. 4, 2007.

(51) Int. Cl.
*E04C 2/38* (2006.01)

(52) U.S. Cl. ..... 52/800.12; 52/58; 52/714; 52/92.1; 52/702; 248/124.1; 248/218.4; 248/300

(58) Field of Classification Search ..... 52/58, 714, 52/92.1, 702, 712, 800.12, 716.2, 716.8; 248/124.1, 218.4, 300
See application file for complete search history.

(56) References Cited

U.S. PATENT DOCUMENTS

| | | | | | |
|---|---|---|---|---|---|
| 673,558 | A | | 5/1901 | Kline | |
| 796,433 | A | * | 8/1905 | Kahn | 403/190 |
| 1,945,925 | A | * | 2/1934 | Stiefel | 403/2 |
| 3,001,748 | A | * | 9/1961 | Austin | 248/468 |
| 3,206,806 | A | * | 9/1965 | Powell | 52/287.1 |
| 3,256,030 | A | * | 6/1966 | Banse | 403/400 |
| 3,390,504 | A | * | 7/1968 | Van Elten | 52/588.1 |
| 3,486,283 | A | * | 12/1969 | Arnett | 52/255 |
| 3,669,480 | A | * | 6/1972 | Fugate | 403/400 |
| 3,855,746 | A | * | 12/1974 | Leggiere | 52/213 |
| 3,858,837 | A | * | 1/1975 | Merritt | 248/300 |
| 4,163,913 | A | * | 8/1979 | Barratt | 310/91 |
| 4,314,428 | A | * | 2/1982 | Bromwell | 52/22 |
| 4,517,776 | A | * | 5/1985 | Barker | 52/90.1 |
| 4,953,339 | A | * | 9/1990 | Jewell | 52/837 |
| 5,201,156 | A | | 4/1993 | Newman | |

(Continued)

FOREIGN PATENT DOCUMENTS

DE 296 06 490 U 7/1996

(Continued)

OTHER PUBLICATIONS

Roof-to-Wall and Deck-to-Wall Flashing: Home Builder's Guide to Coastal Construction, FEMA Aug. 2005, www.fema.gov/library/file?type=publishedFile&file?hgcc_fact24.pdf&fleid=6da444b0-7c0e-11db-9b42-000bdba87d5b.

(Continued)

*Primary Examiner* — Robert J Canfield
*Assistant Examiner* — Matthew J Gitlin
(74) *Attorney, Agent, or Firm* — Brett A. Klein; Dorsey & Whitney LLP

(57) ABSTRACT

An article of flashing for a deck includes a channel with a back leg, a first side leg, and a second side leg and further includes an attachment flange fixedly connected to the channel where the channel is adapted to receive decking. A deck flashing system includes a deck with a surface and at least one edge, decking forming the surface of the deck, and flashing extending along the at least one edge, the flashing having a channel adapted to receive the decking. A method of trimming a deck includes erecting deck framing, installing decking on the framing, and installing flashing on at least one edge or the entire perimeter of the deck.

26 Claims, 15 Drawing Sheets

U.S. PATENT DOCUMENTS

| | | | | |
|---|---|---|---|---|
| 5,613,339 | A | 3/1997 | Pollock | |
| 5,676,486 | A * | 10/1997 | Keith | 403/231 |
| 5,960,591 | A | 10/1999 | Schluter | |
| 6,338,229 | B1 * | 1/2002 | Botzen | 52/371 |
| 6,415,571 | B2 | 7/2002 | Risser | |
| 6,474,032 | B1 | 11/2002 | Wynn | |
| 6,625,941 | B2 * | 9/2003 | Shaw | 52/211 |
| 6,643,986 | B2 | 11/2003 | Commins et al. | |
| 6,837,019 | B2 * | 1/2005 | Collie | 52/712 |
| 6,931,813 | B2 * | 8/2005 | Collie | 52/713 |
| 7,325,367 | B2 * | 2/2008 | Burgess | 52/702 |
| 2002/0178671 | A1 * | 12/2002 | Gembala | 52/302.6 |
| 2003/0159379 | A1 * | 8/2003 | Pickler | 52/283 |
| 2004/0103592 | A1 * | 6/2004 | Edvardsen | 52/58 |
| 2004/0226252 | A1 | 11/2004 | Sheldon | |
| 2005/0126109 | A1 * | 6/2005 | Aldykiewicz et al. | 52/720.1 |
| 2006/0242916 | A1 | 11/2006 | Simko et al. | |
| 2007/0054086 | A1 | 3/2007 | Pagel et al. | |
| 2008/0005975 | A1 | 1/2008 | Thompson | |

FOREIGN PATENT DOCUMENTS

| | | | |
|---|---|---|---|
| DE | 299 12 160 | U | 12/2000 |
| DE | 201 02 641 | U | 7/2001 |
| GB | 1 053 339 | A | 12/1966 |

OTHER PUBLICATIONS

International Search Report for PCT/US2008/075230 dated Dec. 19, 2008.

Reinhold, Tim et al. "Securing Soffits", *Coastal Contractor*, p. 1-6 (Jan./Feb. 2007).

* cited by examiner

DECK FLASHING TRIM SYSTEM

CROSS REFERENCE TO RELATED APPLICATIONS

The present application claims priority to U.S. Provisional Application 60/967,251, filed on Sep. 4, 2007, the contents of which are hereby incorporated herein by reference.

FIELD OF THE INVENTION

This invention relates generally to the field of construction and more specifically to the area of deck construction. More particularly, the present invention relates to a deck flashing trim system.

BACKGROUND OF THE INVENTION

Deck construction is continually evolving and materials and methods are continually changing. Current residential and commercial applications often involve using composite materials for the decking surface, skirt boards, railings, and other areas of a deck. These composite materials are used in exposed areas for their aesthetic appeal but also because of their alleged maintenance free characteristics. However, composite materials are subject to expansion and contraction due to changes in temperature, which can cause multiple issues with the maintenance of the decking and the framing it is attached to.

Deck construction methods naturally create multiple seams across the surface of the deck as well as gaps to allow for drainage. Debris can become trapped in between the composite materials in these seams and gaps. As the composite materials expand and contract, the debris can be compressed against adjacent surfaces causing unintended shifting and movement. In a particular instance, where a skirt board at the edge of a deck extends up along the edge of the deck surface, the lateral expansion of the decking can simply push the skirt board away from the deck. This unintended shifting and movement can cause members of the deck to become unseated or even loose leading to squeaking and further intrusion of debris and worse yet, moisture.

In many cases, decks are supported off of a ledger board attached to the exterior face of a building. In recent years, increasing numbers of deck failures have occurred due to moisture intrusion in and around these ledger boards. Moreover, moisture intrusion generally has become an increasing concern in building construction.

There is a need in the art for a device or system capable of both accommodating the expansion and contraction issues of composite decking materials as well as preventing the intrusion of debris and moisture. Additionally, there is a need for this device or system to remain consistent with the aesthetic appeal of the deck to which it is applied.

SUMMARY OF THE INVENTION

In one embodiment, an article of flashing for a deck includes a channel with a back leg, a first side leg, and a second side leg, and the flashing further includes an attachment flange fixedly connected to the channel, where the channel is adapted to receive decking. In another embodiment, the flashing further includes a skirt flange fixedly connected to the channel at the intersection of the back leg and the second side leg. In yet another embodiment, the flashing includes a drip edge fixedly connected to a free edge of the skirt flange. In still another embodiment, the flashing includes a siding flange fixedly connected to the channel at the intersection of the back leg and the second side leg.

In another embodiment, a deck flashing system includes a deck with a surface and at least one edge, decking forming the surface of the deck, and flashing extending along the at least one edge, the flashing having a channel adapted to receive the decking.

In another embodiment, a method of trimming a deck is provided including erecting deck framing, installing decking on the framing, and installing flashing on at least one edge of the deck or the entire perimeter of the deck. In another embodiment, the flashing has a channel adapted to receive decking. In still another embodiment, the method includes providing a gap between the decking and the back leg of the channel to accommodate expansion and contraction of the decking.

While the present disclosure is directed toward deck construction, further areas of applicability will become apparent from the description provided herein. It should be understood that the description and specific examples are intended for purposes of illustration only and are not intended to limit the scope of the present disclosure.

DESCRIPTION OF THE DRAWINGS

The forgoing features, objects, and advantages of the invention will become apparent to those skilled in the art from the following detailed description, especially when considered in conjunction with the accompanying drawings in which like numerals in the several views refer to the corresponding parts.

DETAILED DESCRIPTION

The following description relates to perimeter and internal flashing for decks. Decks may include any constructed surface, which may be level or slightly sloped, and may be used for support. This may include, but is not limited to decks on homes or buildings, docks, piers, gazebos, porches, boardwalks, and the like and may further be in an exterior or interior condition. The flashing may consist of continuous strips of material in the shape of a channel, sized and configured to receive decking and to accommodate expansion and contraction of the decking. The flashing may also be further shaped to fit along the perimeter edges of a deck including an edge along a building to which a deck may be attached. The flashing may be applied to cover seams and gaps and prevent moisture and debris from entering the seams and gaps. For example, a skirt or fascia board is often placed against the vertical face of the edge joists and rim joists of a deck. The skirt board often extends up along side the edge of the surface decking creating a continuous seam around the perimeter of the deck. The flashing may be applied to cover over the top of this seam and prevent moisture from entering and getting trapped between the skirt board and the joist to which it is attached.

The following description relates to various elements of flashing in various orientations and combinations. The elements described may include, inter alia, a channel, an attachment flange, a skirt flange, a drip edge, and a siding flange. As each of these elements are encountered in the included embodiments, they will be described in detail.

Figure 1A:
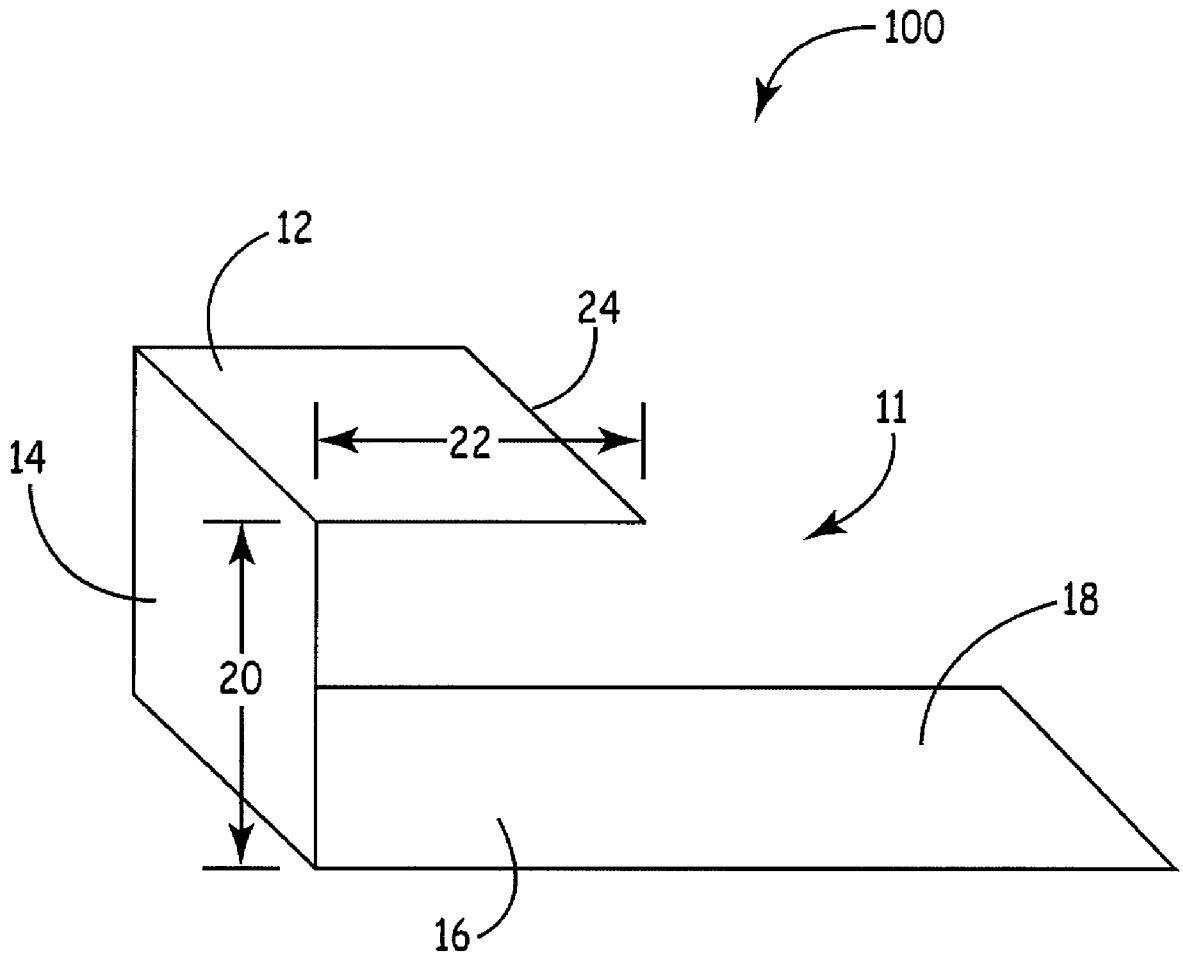
FIG. 1A depicts a cross-section view of an article of flashing, according to certain embodiments.

Referring now to FIG. 1A, a cross section view of one embodiment of flashing 100 is shown. This embodiment includes a channel 11 and an attachment flange 18. The channel 11 shown includes a back leg 14 and two side legs 12, 16. The channel 11 is shown in a horizontal orientation and the attachment flange 18 is also shown in a horizontal orientation, extending from one of the two side legs 12, 16 of the channel 11.

As mentioned, the channel 11 includes a back leg 14 and two side legs 12, 16. Each of the back leg 14 and two side legs 12, 16 may comprise a generally flat piece of material. Alternatively, the back leg 14 and two side legs 12, 16 may be corrugated, wavy, or otherwise have a non-flat shape. The two side legs 12, 16 may be fixedly connected to opposite ends of the back leg 14 and may further extend from the back leg 14 in generally the same direction. The two side legs 12, 16 may also be generally parallel to each other. In the present embodiment, the back leg 14 intersects with each side leg 12, 16 at an angle substantially equal to ninety degrees.

The height 20 of the channel 11 may be adapted to receive decking. This height 20 may vary from about ¼" to about 8" depending on the decking thickness. Alternatively, the height 20 may be established to accommodate most decking and may more particularly be approximately ¾" to 1¾.

The depth 22 of the channel 11 may be adapted to receive decking. This depth 22, as measured from back leg 14 to the outer edge 24 of the shorter of the two side legs 12, 16 may vary from about ¼" to about 8" depending on several factors. The depth 22 of the channel 11 may be increased, for example, where the decking length is uncertain or where a wet condition exists requiring extended overlap. Preferably, the depth 22 of the channel 11 is approximately 1".

The attachment flange 18, as shown in FIG. 1, may be fixedly connected to one end of one of the side legs 12, 16. The present embodiment shows the attachment flange 18 in a horizontal orientation intersecting with the side leg 16 on the bottom of the channel 11 at an angle substantially equal to zero degrees.

The attachment flange 18 may be a generally flat piece of material or may be corrugated, wavy, or otherwise have a non-flat shape. As shown in later embodiments, the attachment flange 18 may be oriented vertically or at any angle and may intersect with a side leg 12, 16 at any angle. The attachment flange 18 may have a gritty or toothed surface to resist displacement and supplement anchorage provided by fasteners.

Figure 1B:
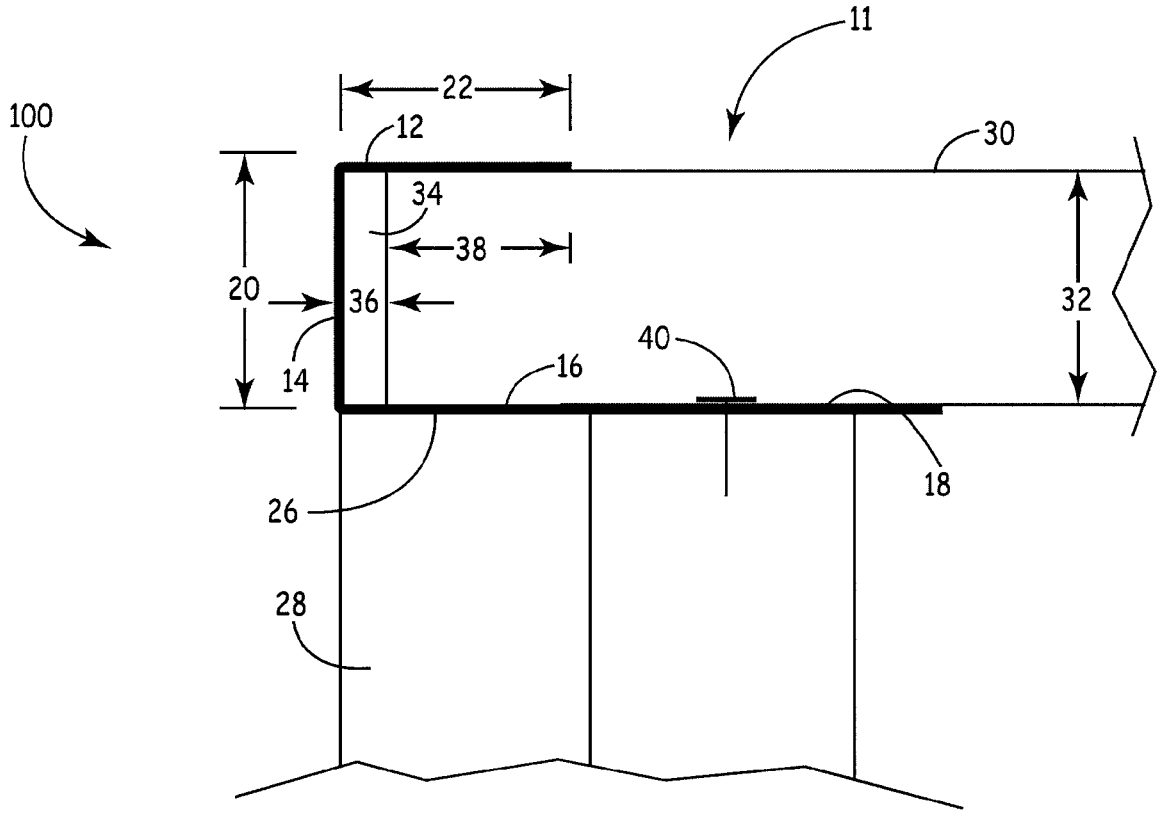
FIG. 1B depicts the embodiment of FIG. 1A in place along a perimeter edge of a deck.

An embodiment of FIG. 1A is shown in use in FIG. 1B. As shown, the flashing 100 may be applied to the top surface 26 of an edge joist or rim joist 28. In many cases this edge or rim joist 28 may be a double member or multiple member for support of railing posts or future wall support. It is noted that the edge joists or rim joist could be any member of a deck including stair stringers and the like where a seam or edge is to be flashed. The channel 11 of the flashing 100 may be in place prior to the decking 30 and may be adapted to receive the decking 30. As shown, the height 20 of the channel 11 may be equal to or slightly greater than the decking thickness 32. As also shown, the decking material 30 may be cut to fit into the channel 11 and stop slightly short of the back leg 14 of the channel. The created gap 34 allows for the expansion and contraction of the decking 30. The depth 22 of the channel 11 may be equal to the width 36 of the created gap 34 plus a certain amount of overlap 38 of the channel 11 with the decking 30. The width 36 of the created gap 34 may range from 0" to 4" and is preferably about a ¼" gap.

The embodiment shown in FIG. 1B may be used to cover an edge, multiple edges, or the entire perimeter of a deck to cap over the outer edge. Additionally, it may be appropriate for use along a rim joist 28 of a deck where interior deck joists are intermittently framing into the inside face of the rim joist 28. These intermittently framing joists may cause interference with a vertically oriented attachment flange 18 making the horizontally oriented attachment flange 18 shown here more effective.

The flashing 100 may be attached to the top surface 26 of the rim or edge joist 28 with appropriate fasteners 40 placed through the attachment flange 18. Preferably, the fasteners are located in non-visible area so as to not detract from the clean looking edge. These fasteners 40 may be galvanized siding nails or screws or other fasteners known in the art. Alternatively, the attachment flange 18 may include teeth for attachment to the support structure. These teeth may be similar to those provided on a truss plate and may be provided continuously along the attachment flange 18 or may be in the form of distinct isolated patterns spaced along the length of the attachment flange 18. In this embodiment, the flashing may be attached by pressing the teeth of the attachment flange 18 into the support structure. This may be done with a hammer or with other mechanical pressing means.

Figure 2A:
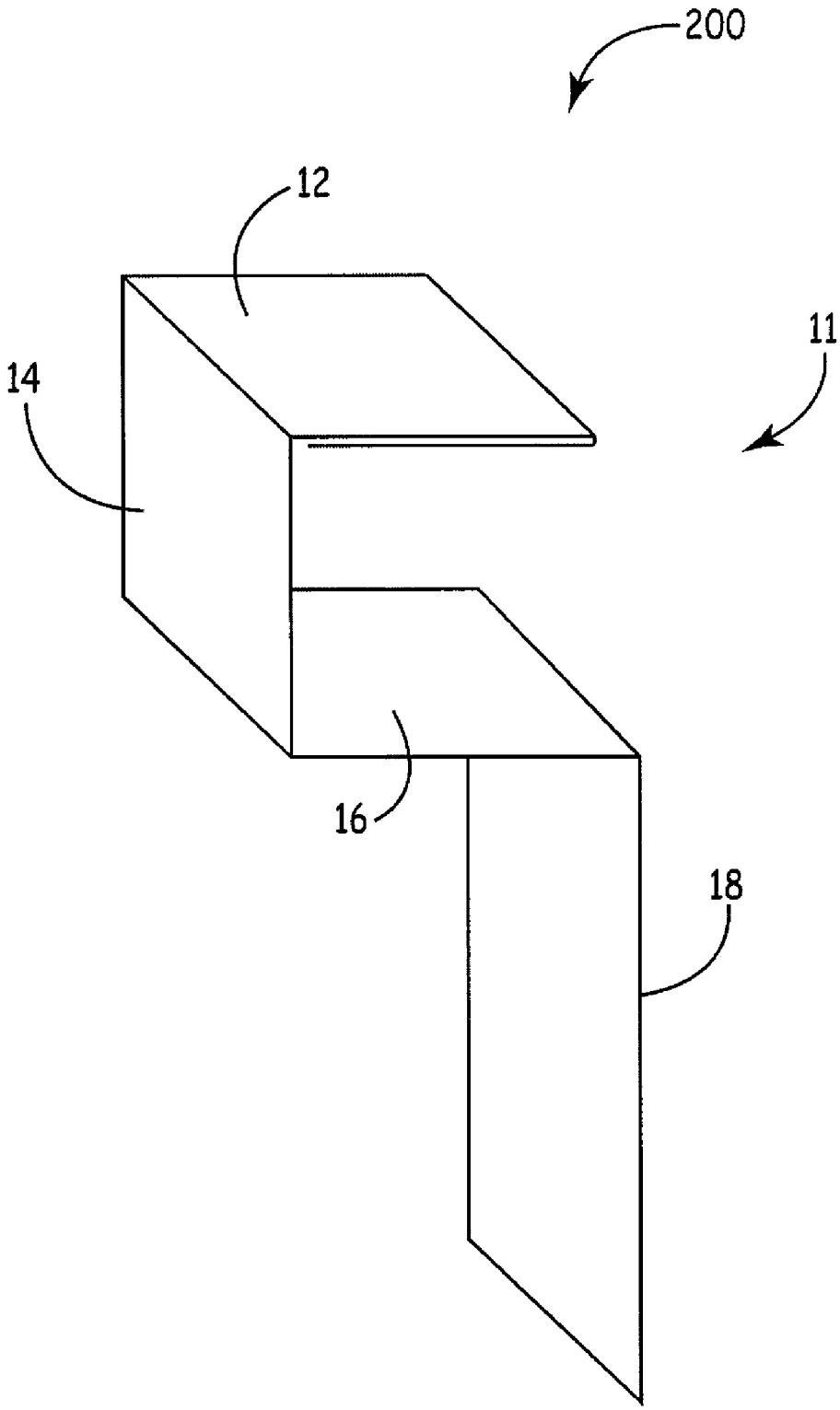
FIG. 2A depicts a cross-section view of an article of flashing, according to certain embodiments.

Referring now to FIG. 2A, a cross section view of another embodiment of flashing 200 is shown. This embodiment, like that shown in FIG. 1A, includes a channel 11 and an attachment flange 18. The channel 11 and attachment flange 18 elements of this embodiment may be the same or similar to those described with respect to FIG. 1A. However, in contrast to that shown in FIG. 1A, the attachment flange 18 here is oriented vertically and intersects with the side leg 16 on the bottom of the channel 11 at an angle substantially equal to ninety degrees and extends in a direction away from the channel 11.

Figure 2B:
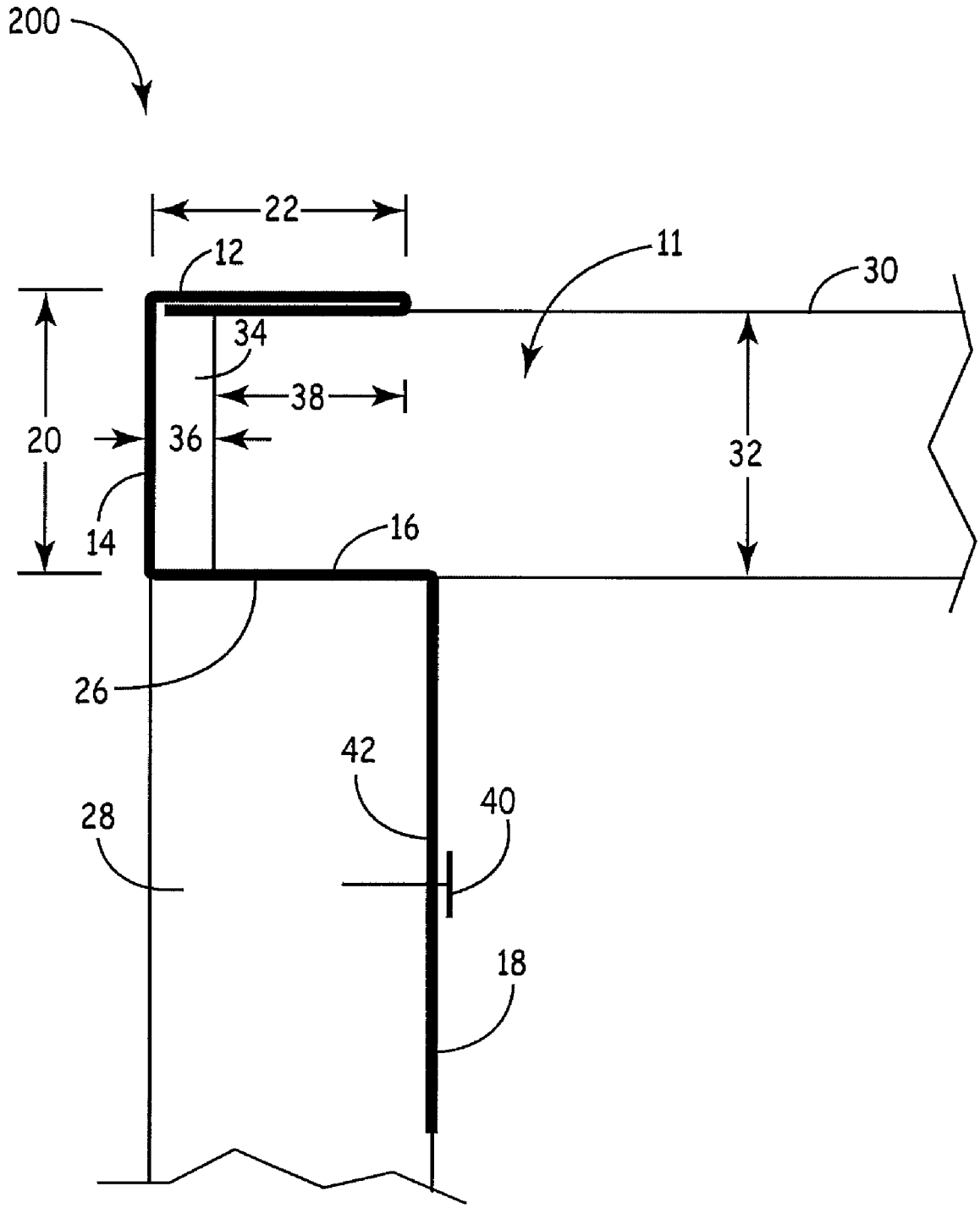
FIG. 2B depicts the embodiment of FIG. 2A in place along a perimeter edge of a deck.

An embodiment of FIG. 2A is shown in use in FIG. 2B. As shown, the flashing 200 may be applied to the top 26 and interior surface 42 of an edge joist or rim joist 28. As mentioned with respect to FIG. 1B, this edge or rim joist 28 may be a single or multiple member. Where it is only a single member, the horizontal surface available for attachment of the flashing 200 is minimized and the vertically oriented attachment flange 18 allows for the flashing 200 to be secured.

As with FIG. 1B, the channel 11 of the flashing 200 may be in place prior to the decking 30 and may be adapted to receive the decking 30. As shown, the height 20 of the channel may be equal to or slightly greater than the decking thickness 32 and the decking material may be cut to fit into the channel 11 and stop slightly short of the back leg 14 of the channel 11. The created gap 34 allows for the expansion and contraction of the decking 30 and the depth 22 of the channel 11 may be determined by adding the desired gap 36 to the desired amount of overlap 38. The flashing 11 may be attached to the interior surface 42 of the rim or edge joist 28 with appropriate fasteners 40 placed through the attachment flange 18.

Figure 3A:
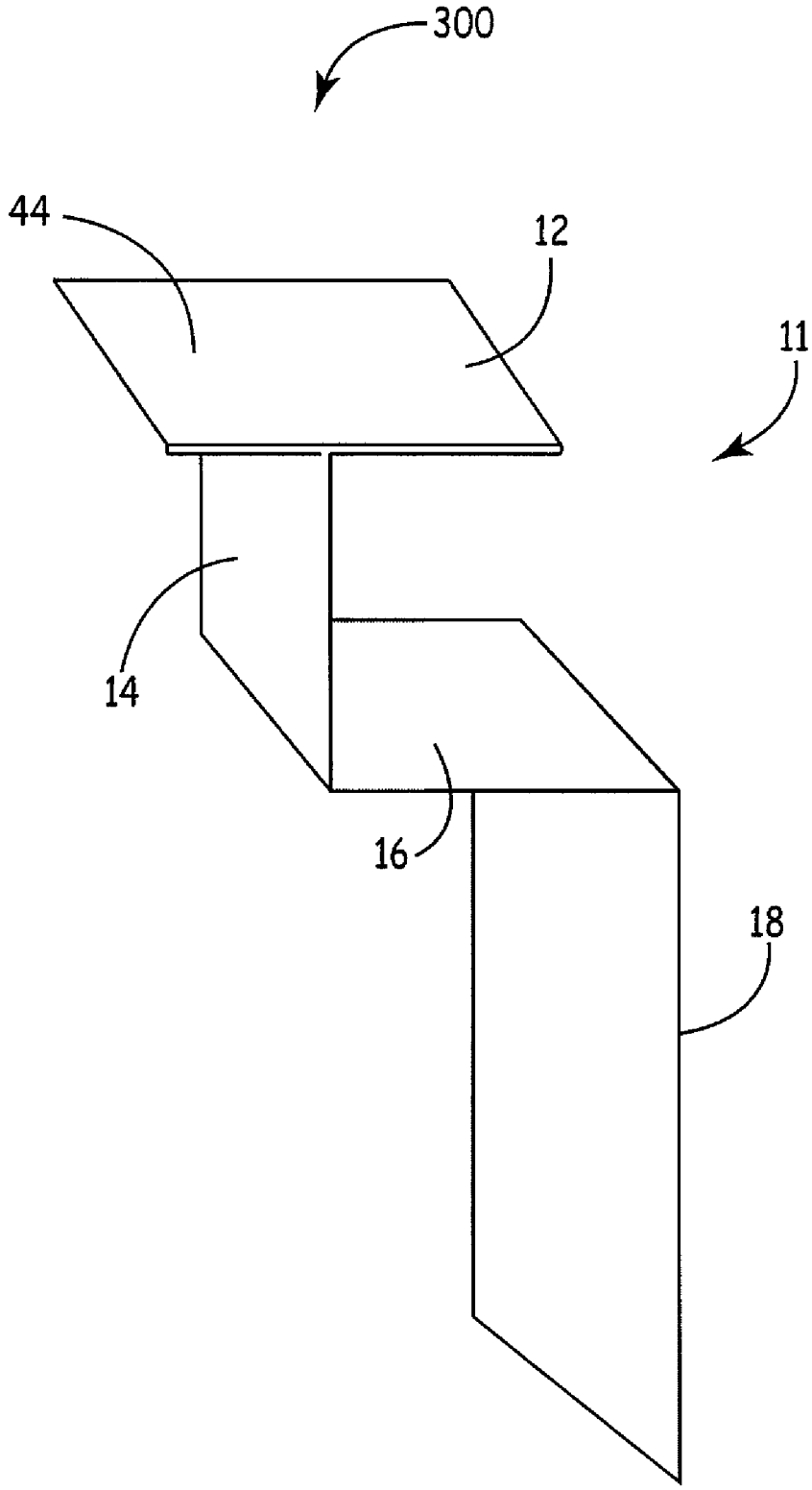
FIG. 3A depicts a cross-section view of an article of flashing, according to certain embodiments.

Referring now to FIG. 3A, a cross section view of another embodiment of flashing 300 is shown. In this embodiment, the flashing 300 includes, as in the previous embodiments, a channel 11 and an attachment flange 18. The channel 11 and attachment flange 18 elements of this embodiment may be the same or similar to those described with respect to FIG. 1A or 2A. In the embodiment shown, they are most similar to that shown in FIG. 2A. However, in contrast to FIGS. 1A and 2A, the present embodiment includes a skirt flange 44. The skirt flange 44 is shown extending away from the channel 11 at the intersection of the top side leg 12 and the back leg 14 of the channel 11.

The skirt flange 44 may be a generally flat piece of material and may be oriented horizontally. The skirt flange may range from 1/32" in length up to approximately 8". Preferably, the skirt flange is approximately ¾.

Figure 3B:
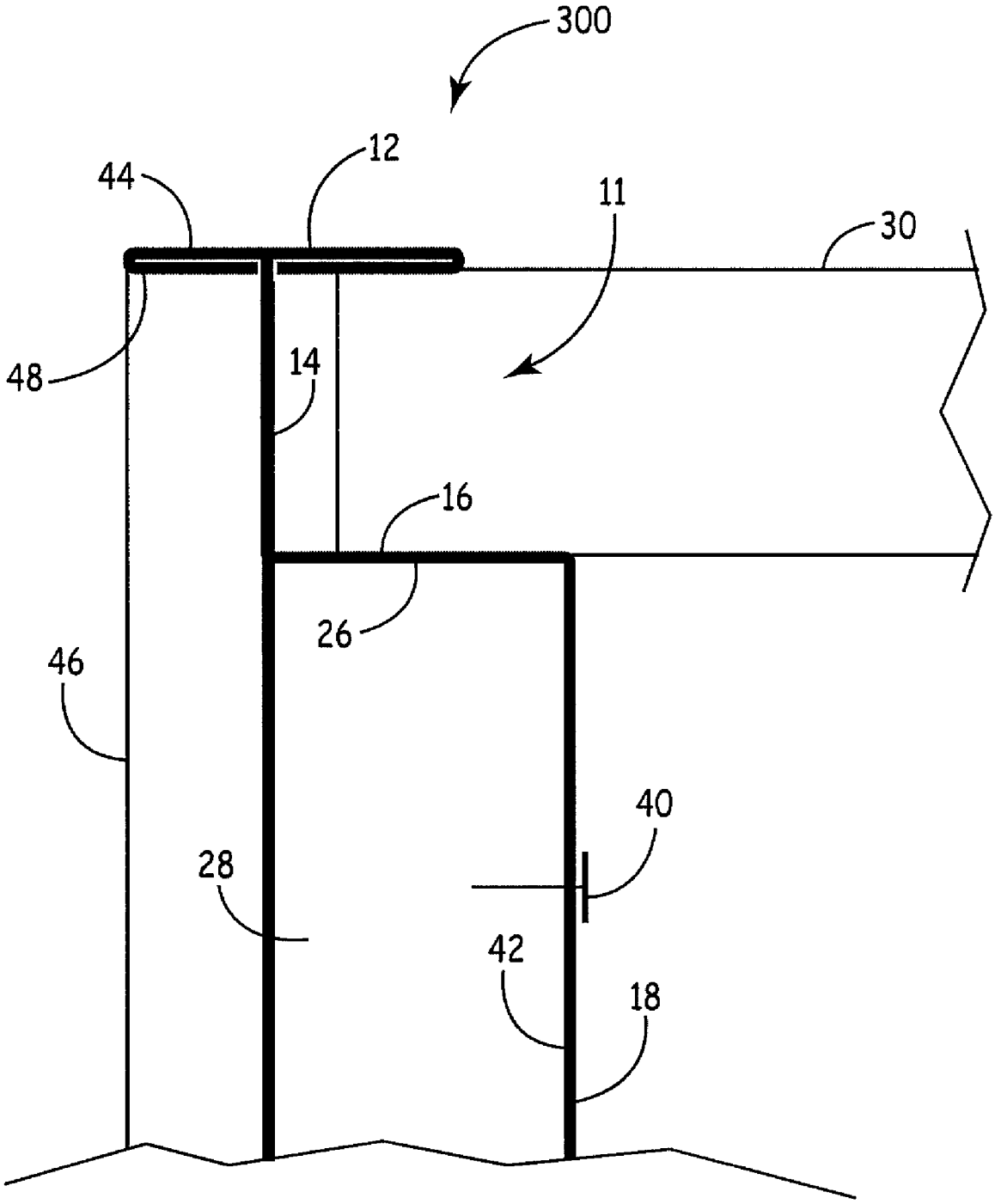
FIG. 3B depicts the embodiment of FIG. 3A in place along a perimeter edge of a deck with a skirt board.

An embodiment of FIG. 3A is shown in use in FIG. 3B. As shown, the flashing 300 may be applied to the top 26 and interior surface 42 of an edge joist or rim joist 28. That is, the attachment flange 18 may be positioned along the inside face 42 of the rim or edge joist 28 and the channel 11 may be positioned to rest on the top 26 of the joist 28. This position allows the skirt flange 44 to extend laterally away from the joist 28 to accommodate a skirt board 46 by extending over the skirt board's top edge 48 as shown. As with previous embodiments, the channel 11 of the flashing 300 may be in place prior to the decking 30 and may be adapted to receive the decking 30 and the flashing 300 may be attached to the rim or edge joist 28 with appropriate fasteners 40 placed through the attachment flange 18.

Figure 3C:
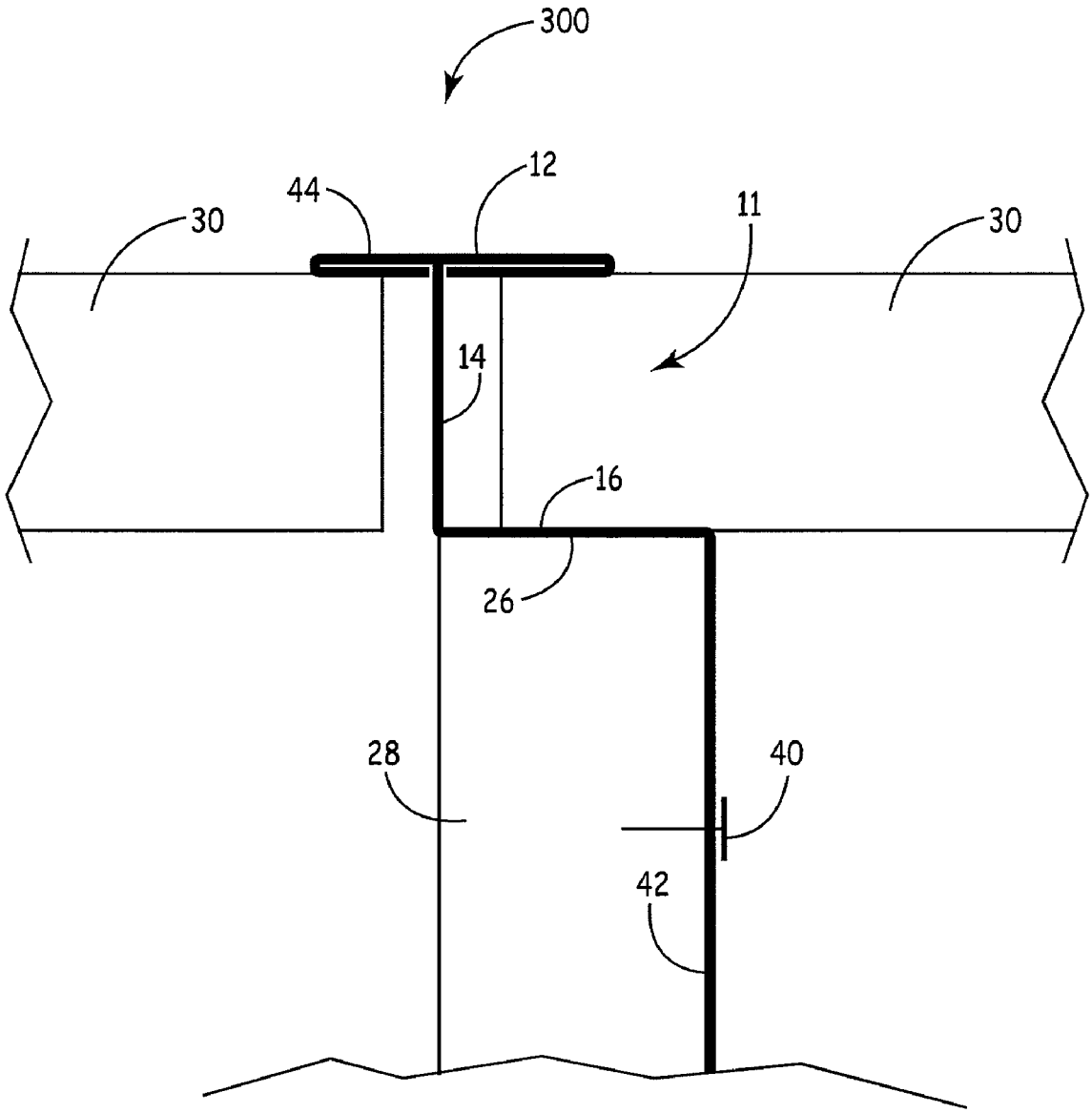
FIG. 3C depicts the embodiment of FIG. 3A in place along an interior seam of a deck.

Another embodiment of FIG. 3A is shown in use in FIG. 3C. As shown, the flashing 300 may be used to accommodate an internal seam where decking 30 is received from both directions. This may be useful on internal tracks of decking 30 that may alternate color, orientation, or some other element of design or structure requiring a finished edge. As shown, the flashing 300 may be applied to the top 26 and side surface 42 of a joist 28. That is, the attachment flange 18 may be positioned along the side face 42 of the joist 28 and the channel 11 may be positioned to rest on top 26 of the joist 28. This position allows the channel 11 to receive decking 30 from one side and the skirt flange 44 to receive decking 30 from the other side. In this embodiment, the skirt flange length may be adjusted to receive decking. It may be adjusted to match the depth of the channel or may be any other length. Those skilled in the art will understand and appreciate that two back to back channels 11 may also be provided and that the channels may also share a back leg 14. As with previous embodiments, the flashing 300 may be attached to the joist 28 with appropriate fasteners 40 placed through the attachment flange 18.

Figure 4A:
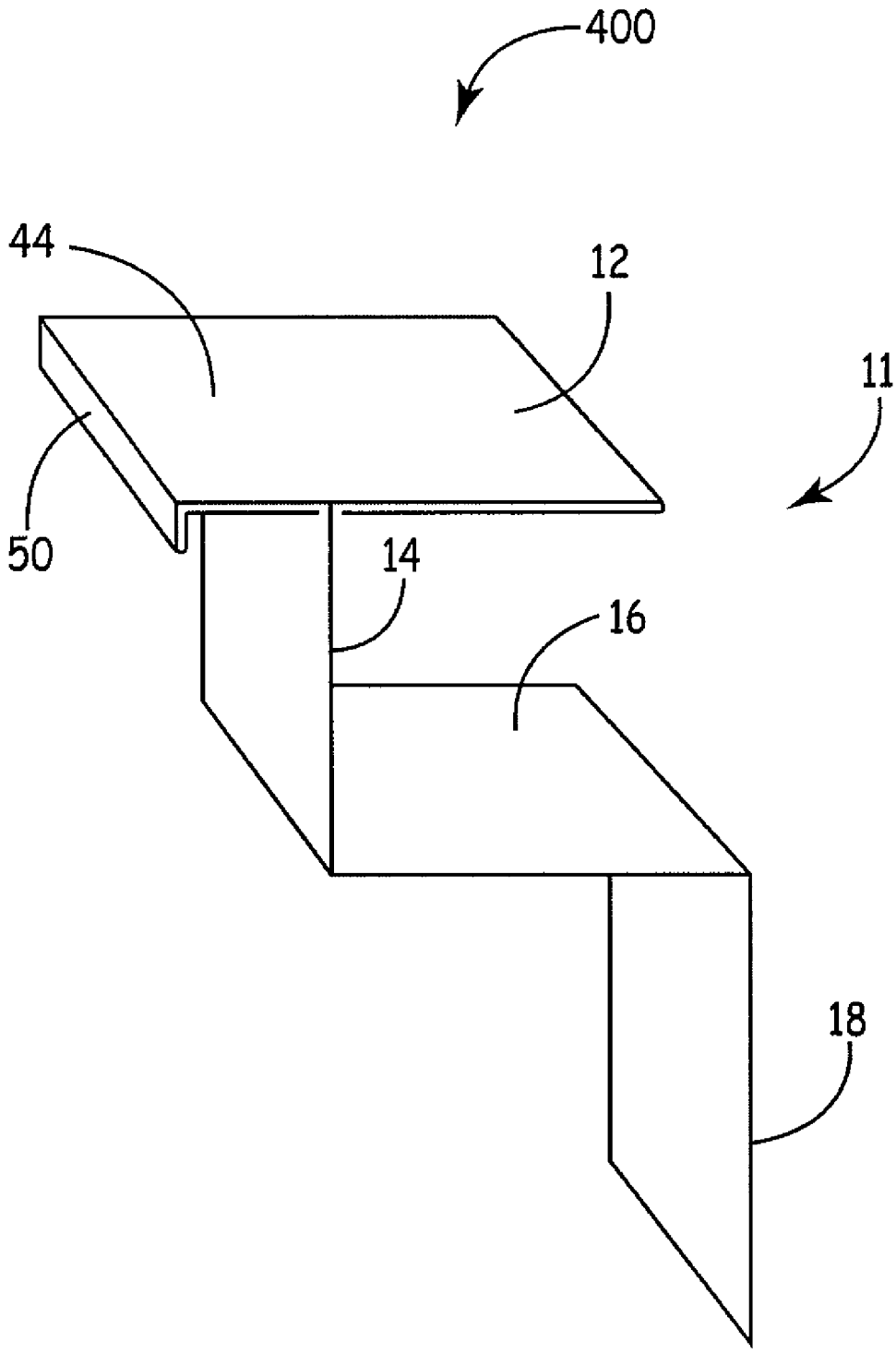
FIG. 4A depicts a cross-section view of an article of flashing, according to certain embodiments.

Referring now to FIG. 4A, a cross section view of another embodiment of flashing 400 is shown. In this embodiment, the flashing 400 includes, as in the previous embodiments, a channel 11 and an attachment flange 18. The channel 11 and attachment flange 18 elements of this embodiment may be the same or similar to those described with respect to FIG. 3A. However, in contrast to FIG. 3A the present embodiment includes a drip edge 50. The drip edge 50 is shown extending downward from the skirt flange 44. The drip edge 50 may extend a short distance down from the skirt flange 44 or may extend a longer distance. The drip edge may range from 1/32" to 8" or longer. Preferably, the drip edge may be ⅜" long.

Figure 4B:
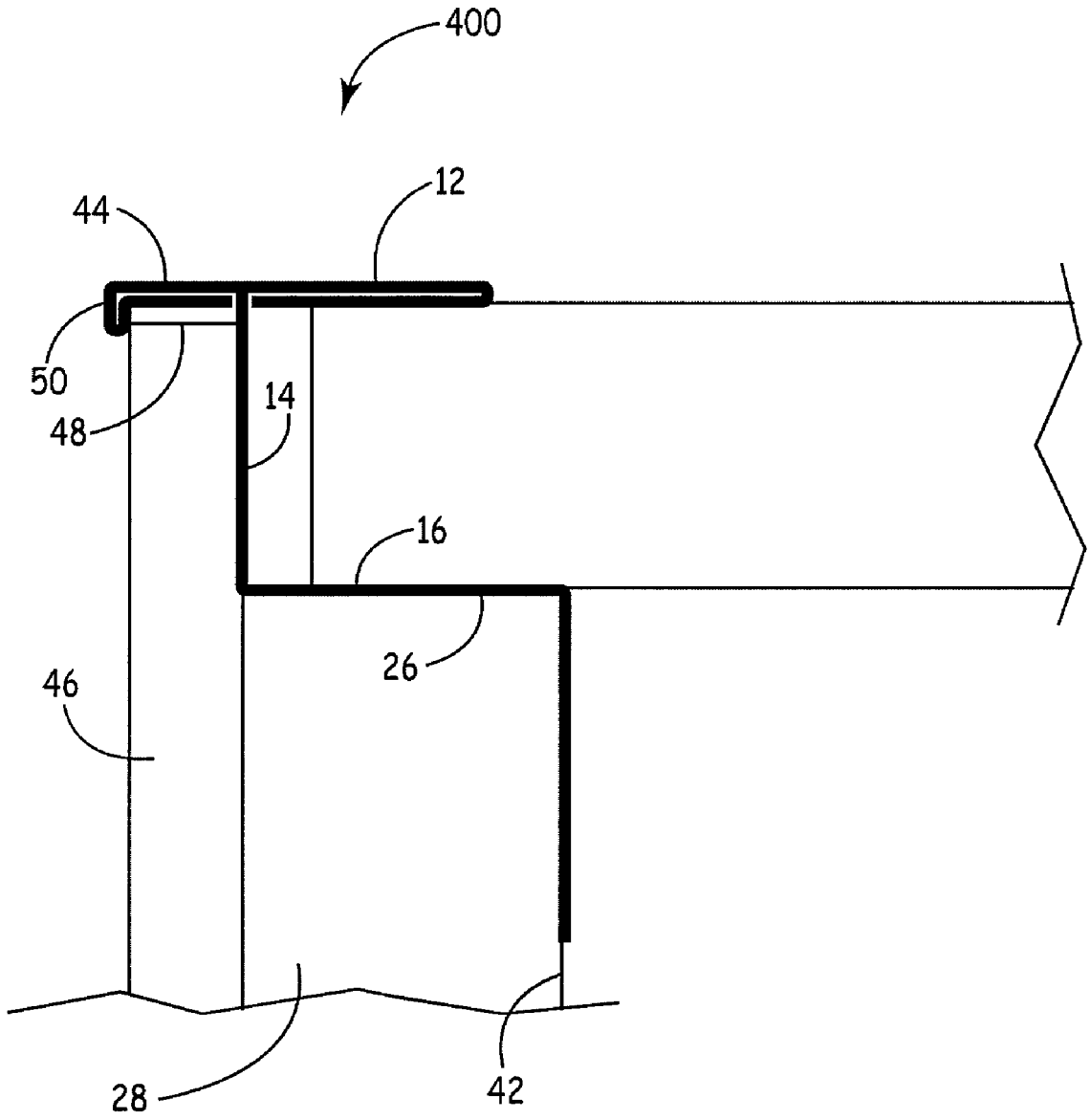
FIG. 4B depicts the embodiment of FIG. 4A, in place along a perimeter edge of a deck with a skirt board.

An embodiment of FIG. 4A is shown in use in FIG. 4B. Like FIGS. 2B and 3B, the flashing 400 may be applied to the top 26 and interior surface 42 of an edge joist or rim joist 28. As shown, the drip edge 50 is situated such that it laps over the side of the skirt board 46. Where water may be running off of the surface of the flashing 400, the drip edge 50 may ensure that the water does not wick into the seam between the skirt flange 44 and the skirt board 46. That is, in the absence of a drip edge 50, water may enter this seam due to its surface tension properties. With the drip edge 50 in place, the water is forced to travel downward. While the tendency to wick may still occur between the outside face of the skirt board 46 and the drip edge 50, in this case the wicking is counteracted at least in part by gravitational forces. Moreover, where the skirt board 46 is held down slightly from the bottom of the skirt flange 44 as shown, the seam creating a wicking tendency may be limited to a short distance defined by the overlap between the drip edge 50 and the outside surface of the skirt board 46. Thus, water may not tend to propagate up and across the skirt board 46.

Figure 5A:
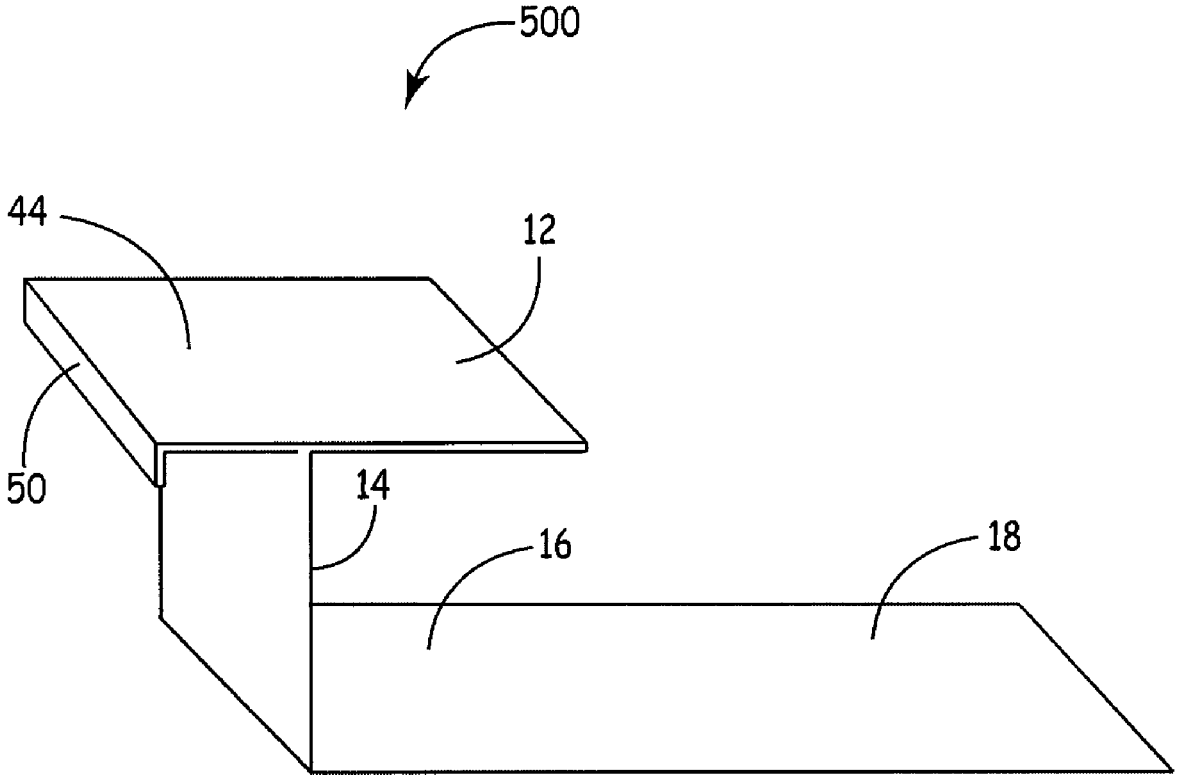
FIG. 5A depicts a cross-section view of an article of flashing, according to certain embodiments.
Figure 5B:
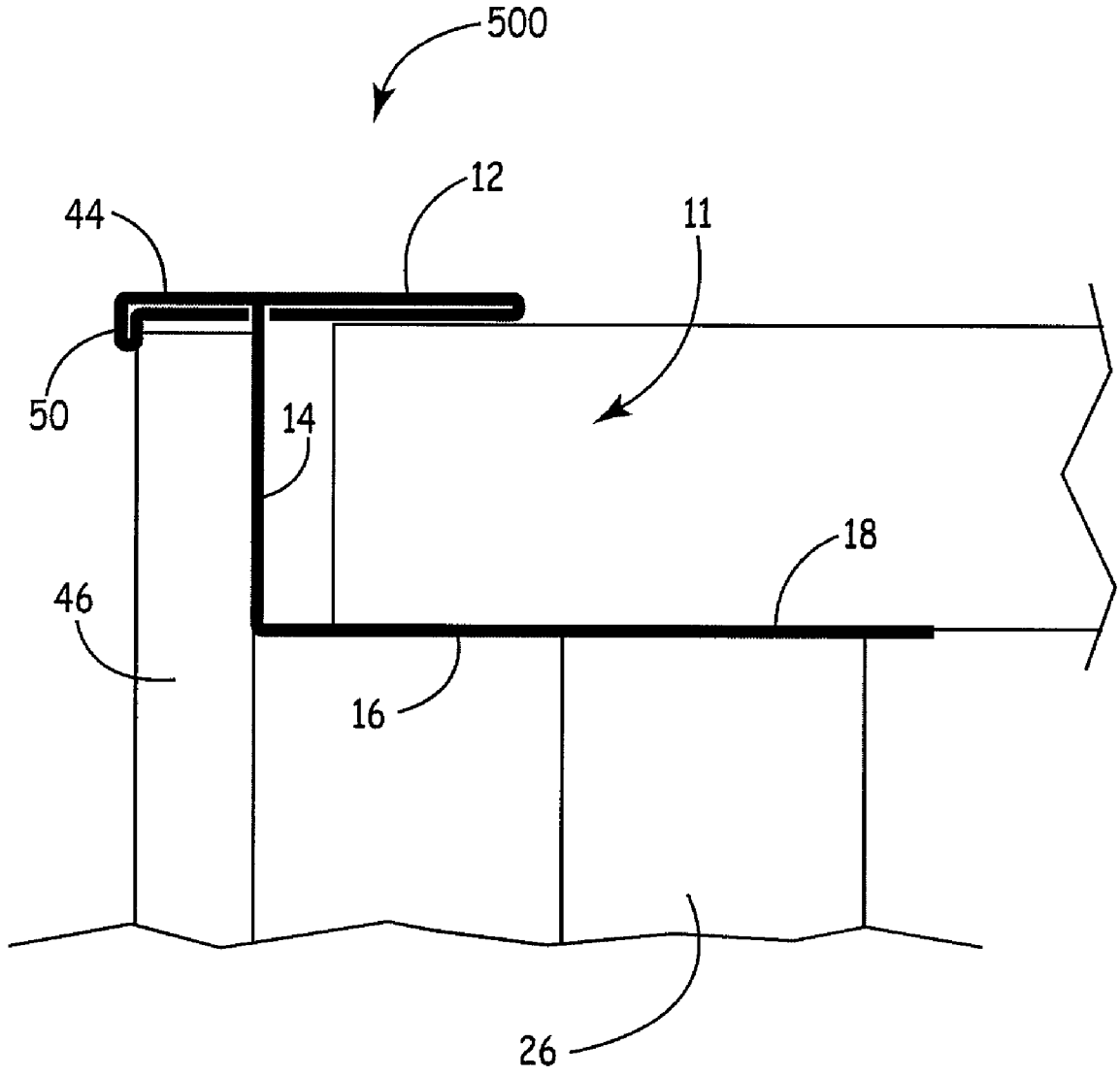
FIG. 5B depicts the embodiment of FIG. 5A, in place along a perimeter edge of a deck with a skirt board.

Referring now to FIG. 5A, a cross section view of another embodiment is shown. This embodiment is the same or similar to that shown in FIG. 1A, but further includes a skirt flange 44 and a drip edge 50. This combination of elements allows this embodiment to be installed on a rim or edge joist 28 where internal framing members may prevent the embodiment of FIG. 4A to be installed. An embodiment of FIG. 5A is shown in use in FIG. 5B.

Figure 6A:
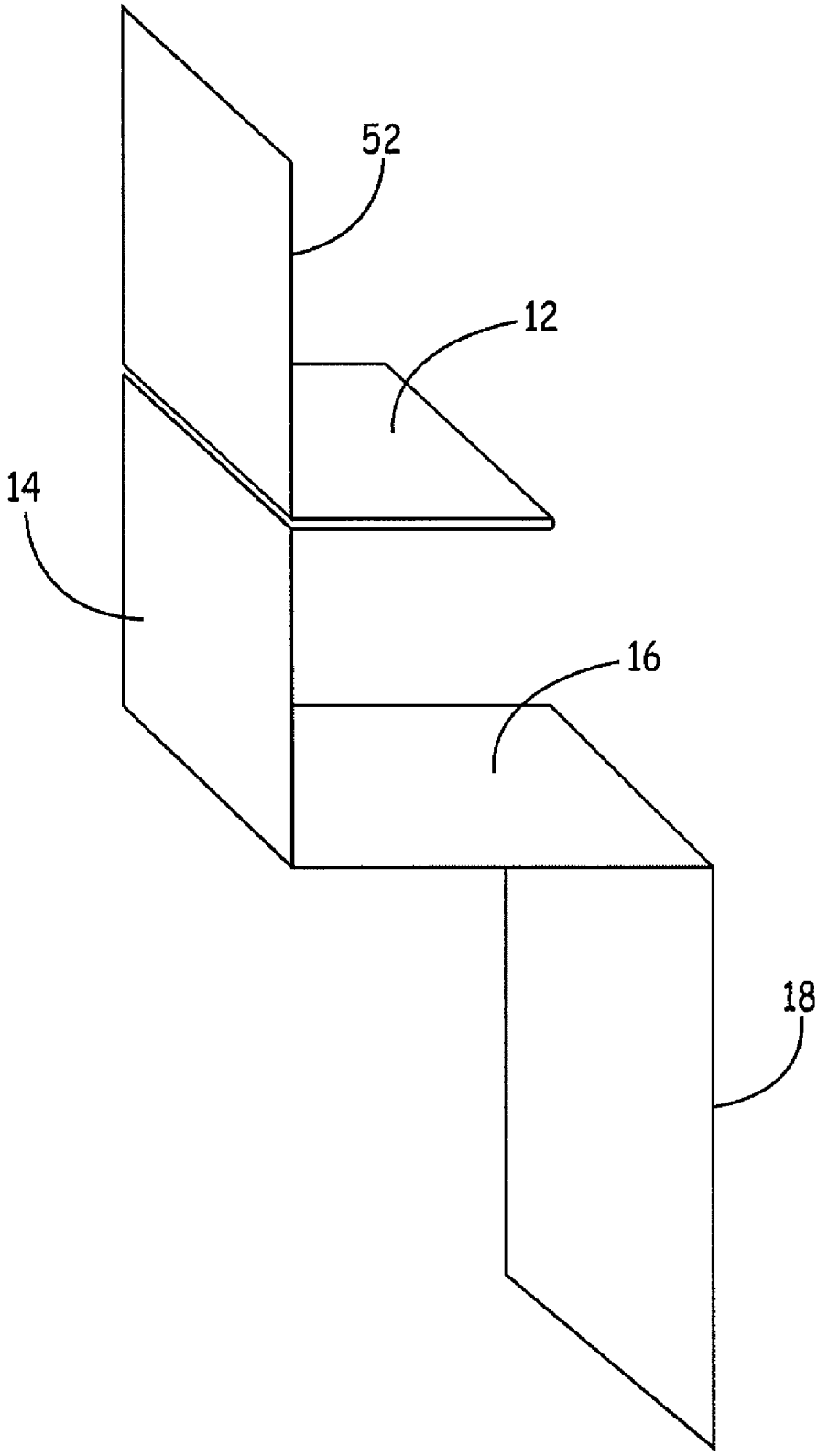
FIG. 6A depicts a cross-section view of an article of flashing, according to certain embodiments.

Referring now to FIG. 6A, a cross section view of another embodiment of flashing 600 is shown. In this embodiment, the flashing 600 includes, as in the previous embodiments, a channel 11 and an attachment flange 18. The channel 11 and attachment flange 18 elements of this embodiment may be the same or similar to those described with respect to FIG. 1A or 2A. In the embodiment shown, they are most similar to that shown in FIG. 2A. However, in contrast to FIGS. 1A and 2A, the present embodiment also includes a siding flange 52 extending upward from the intersection of the top side leg 12 and the back leg 14 of the channel 11.

The siding flange 52 may be a generally flat piece of material or may be corrugated, wavy, or otherwise have a non-flat shape and may be oriented vertically so as to accommodate attachment to a vertical face of a building. The siding flange 52 may extend a short distance upward from the channel or a large distance. The range of extension of the siding flange 52 may be from a ½" up to 12". In some embodiments, the siding flange 52 may be sloped slightly outward away from the channel 11 so as to be flexed inward (toward the channel) as the flashing 600 is pressed against the outer wall of a building. This may provide for a tight sealing fit between the siding flange 52 and the building. Additionally, various sealants are known in the art for sealing flashing to a building.

Figure 6B:
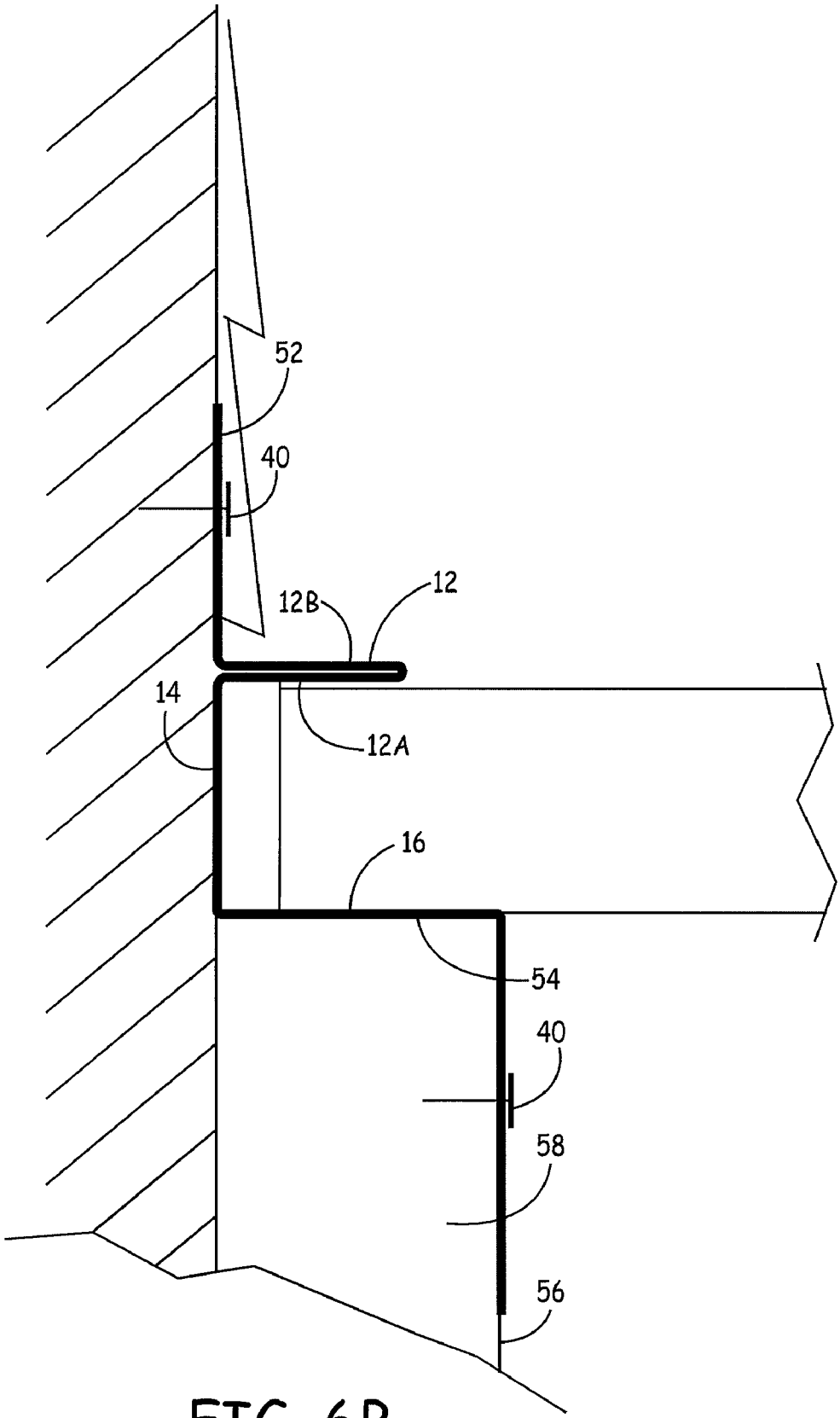
FIG. 6B depicts the embodiment of FIG. 6A, in place along a building abutting perimeter edge of a deck.

An embodiment of FIG. 6A is shown in use in FIG. 6B. As shown, the flashing 600 may be applied to the top 54 and interior surface 56 of a ledger board 58 on a building. (Interior here is relative to the deck, not the building) That is, the attachment flange 18 may be positioned along the inside face 56 of the ledger board 58 and the channel 11 may be positioned to rest on the top 54 of the ledger board 58. The siding flange 52 may be placed flat against the exterior surface of a building structure and may be covered with building wrap and exterior siding. The siding flange 52 may be fastened to the wall and may be sealed with known methods and materials. As with previous embodiments, the channel 11 of the flashing 600 may be in place prior to the decking 30 and may be adapted to receive the decking 30 and the flashing 600 may be attached to the ledger board 58 and/or building with appropriate fasteners 40 placed through the attachment flange 18 and/or the siding flange 52. In one embodiment, the attachment flange 18 may be omitted and the siding flange may double as a siding flange 52 and attachment flange 18. That is, the siding flange 52 extending from the top of the channel 11, may be fastened to the building to secure the flashing and the attachment flange 18 may be omitted. In still another embodiment, a short stub of the attachment flange may be included to provide a drip edge type detail and the flashing may be attached via the siding flange.

Those skilled in the art will understand and appreciate that various combinations of the above disclose elements may be made to the flashing disclosed herein and still be within the scope of the invention. For example, various combinations of the elements described herein could be included ranging from any stand alone element to a combination of two or more elements or even all elements. Some examples of this may be to include a drip edge 50 in the embodiment shown in FIG. 1A extending away from the channel off of the intersection between the back leg 14 and the bottom side leg 16. A similar approach could be used with the embodiment of FIG. 2A. As just discussed, the embodiment of FIG. 6A may be used with or without the attachment flange 18 and the flashing may be secured via the siding flange 52, or the attachment flange 18 may be included but may be short so as to act more akin to a drip edge 50. Those skilled in the art will understand and appreciate these and other combinations which are thus within the scope of the invention.

Those skilled in the art will understand and appreciate that various modifications may be made to the flashing disclosed herein and still be within the scope of the invention. For example, the attachment flange 18 has been shown as intersecting with the channel 11 at the outer edge of the bottom side leg 16 of the channel 11 at either zero or ninety degrees. This could range anywhere from zero to 180 degrees or more as necessary to accommodate a decking structure. Moreover, the intersection of the attachment flange 18 and the channel 11 would not need to occur at the outer edge of the bottom side leg 16. The attachment flange 18 could extend vertically downward from any point along the bottom leg 16 of the channel 11 and actually may extend at any angle from any point on the channel 11. One example of this is when the siding flange 52 doubles as an attachment flange 18 and the siding flange extends from the intersection of the top side leg 12 and the back leg 14. Other examples will be apparent to those skilled in the art.

For example, the attachment flange 18 may be connected to the channel 11 at the intersection between the back leg 14 and the bottom side leg 16. In this embodiment, the attachment flange 18 may be secured to the outside edge of a rim or edge joist 28 of a deck. This may be advantageous because this attachment may allow for the flashing to avoid interfering with the internal framing of the deck structure, which may intermittently frame into the inside surface of a rim joist 28.

Additional modifications within the scope of the invention may include varying the intersection angles of the legs 12, 14, 16 of the channel 11. For example, one side leg 12 or 16 may intersect with the back leg 14 forming an acute angle and the other side leg 12 or 16 may intersect with the back leg 14 forming an obtuse angle, the resulting channel 11 having a parallelogram shaped cross-section. This may provide for an aesthetic detailing allowing for a chamfered deck edge or a pointed lip edge. Alternatively, the channel 11 may comprise a single C or U-shaped element or may comprise any shape with an open side to receive decking.

An additional modification within the scope of the invention may include creating a channel 11 with a slight clamping force. The side leg 16 on the bottom of the channel 11 may be substantially horizontal and the side leg 12 on the top of the channel 11 may slope slightly downward making the height 20 of the channel 11 at the open end slightly smaller than the height 20 of the channel 11 at the closed end. This may provide for a tight fit with the decking 30 and may require that the side leg 12 on the top be flexed upward when the decking 30 is inserted. This sloping top side leg 12 may create a sealing force against the surface of the decking 30. Additionally, the outer edge 24 of the side leg 12 may be folded over (e.g. hem) or otherwise reinforced to provide a stiffened edge. This stiffened edge may assist the flashing in sealing against the decking 30 and maintaining a straight edge free from warping, waving, or bending. It is noted here that any free edge may be stiffened in such a way to provide a hemmed type edge rather than a raw edge. Alternatively, the flashing may be sealed against the deck with a sealant.

Similar to that just discussed regarding the top side leg 12 of the channel 11, in some embodiments, the skirt flange 44 may also be sloped slightly downward so as to be flexed upward upon placement of the skirt board. This may provide for a tight sealing fit between the skirt flange 44 and the skirt board.

Figure 4C:
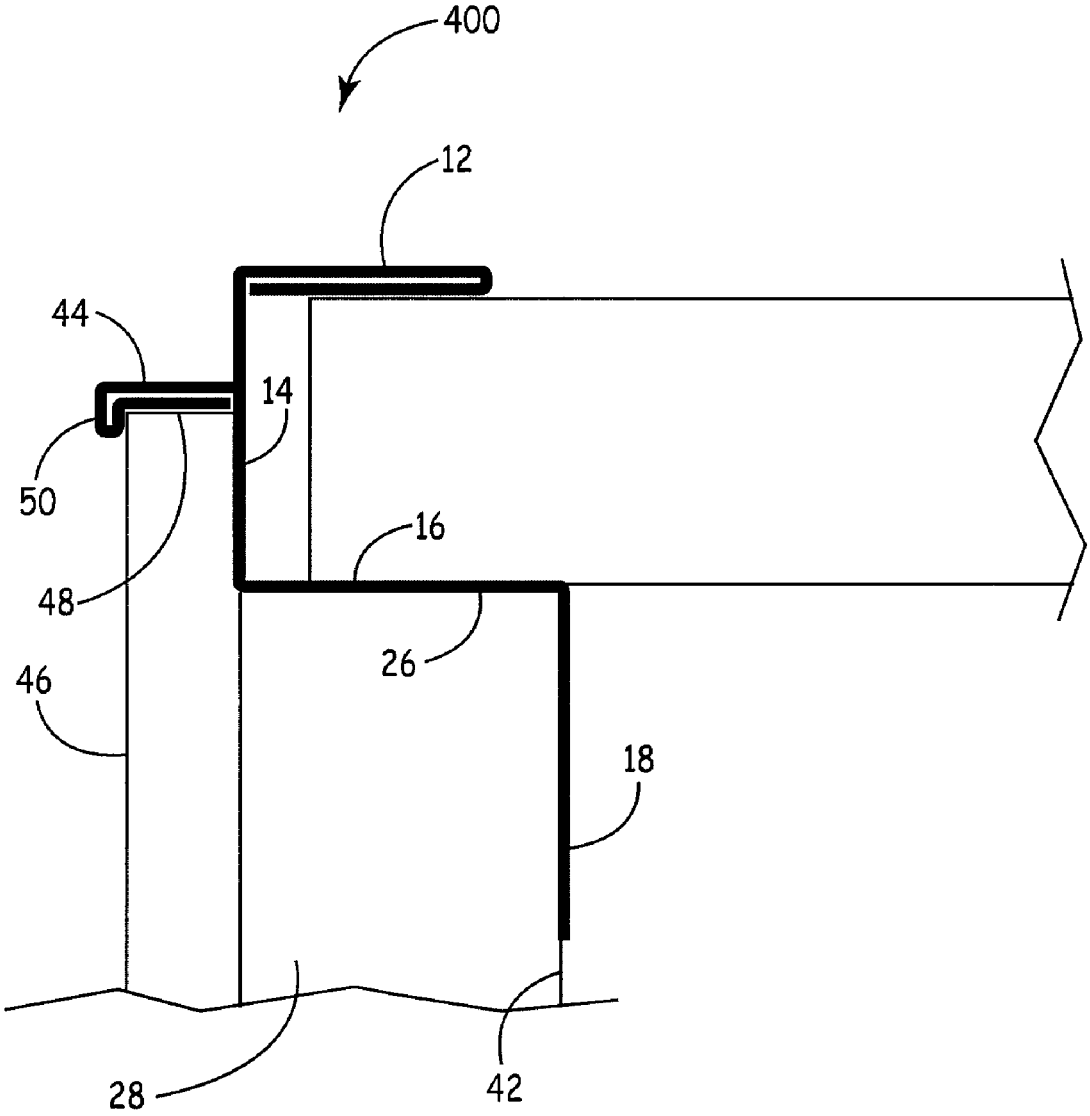
FIG. 4C depicts a cross-section view of an article of flashing according to certain embodiments, in place along a perimeter edge of a deck with a skirt board.
Figure 4D:
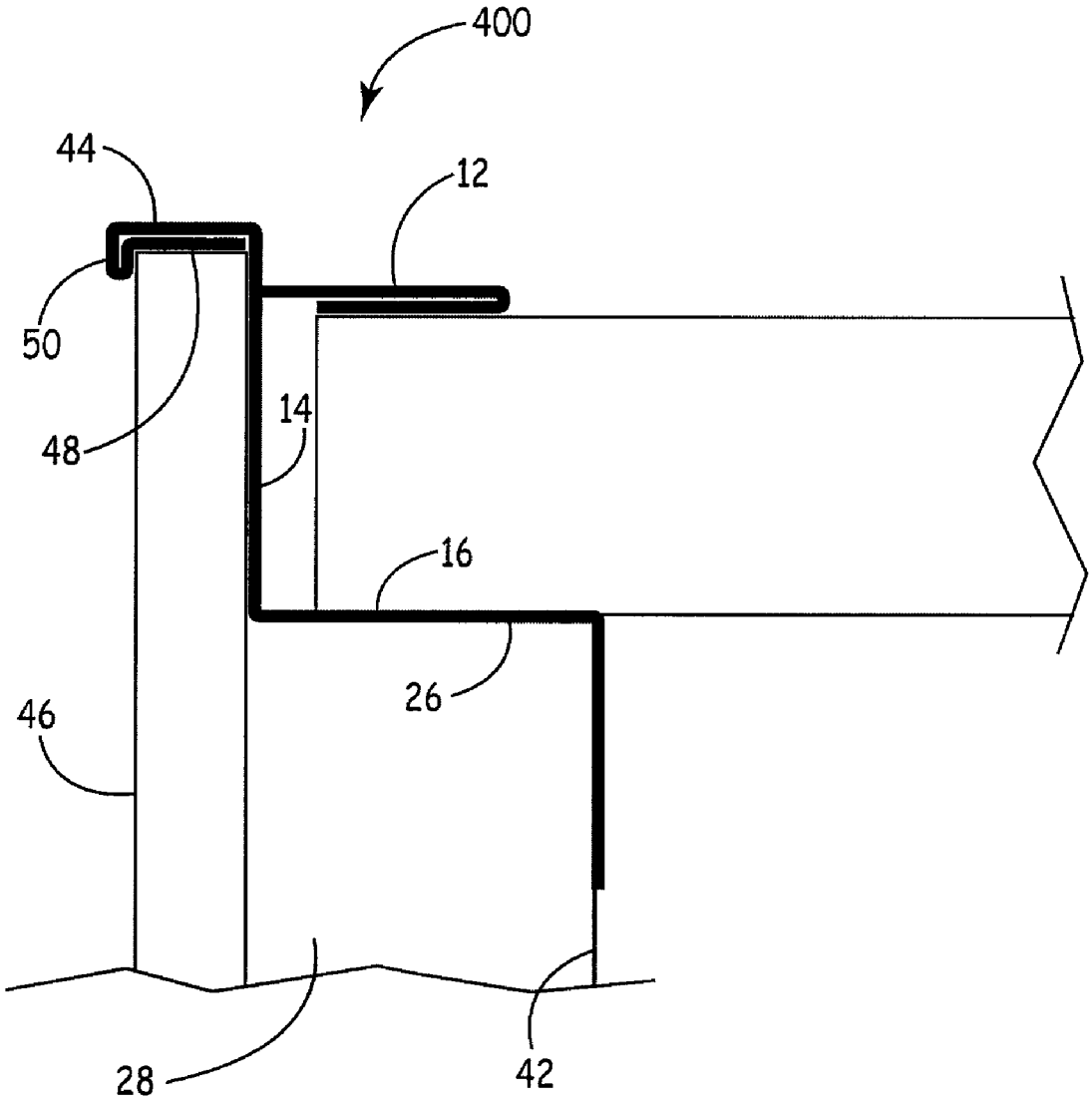
FIG. 4D depicts a cross-section view of an article of flashing according to certain embodiments, in place along a perimeter edge of a deck with a skirt board.

Additionally, in some embodiments, the skirt flange 44 may not be oriented horizontally. For example, where the top 48 of a skirt board 46 is not flush with the top of the decking 30, but is slightly lower than the deck surface as shown in FIG. 4C, the skirt flange 44 may be stepped down from the top side flange 12 as shown or may be sloped slightly downward across the top 48 of the skirt board 46 to create a chamfered edge on the deck. Alternatively, where the top 48 of the skirt board 46 sits higher than the deck surface as shown in FIG. 4D, the skirt flange 44 may extend upward from its intersection with the channel 11, form a ninety degree bend when it reaches the top 48 of the skirt board 46 and then extend horizontally across the top of the skirt board 46.

An additional modification may include re-orienting the channel 11. In the embodiments shown herein, the channel 11 is generally oriented horizontally such that the open end opens to the side. Other orientations such as, but not limited to, vertical or diagonal are within the scope of the disclosure.

Appropriate fasteners 40 may include, but are not limited to shingle nails, siding nails, screws, or staples. In some embodiments, the fasteners may be galvanized to resist corrosion due to exterior exposure and also due to the corrosive nature of some pressure treated lumber. Those skilled in the art will understand and appreciate the various fasteners available which are within the scope of the invention.

The flashing described herein may be made from any material. Preferably, the flashing is made from a formable non-corrosive metal material. This may include, but is not limited to aluminum, galvanized metal, (e.g. G185 or Zmax), or stainless steel. Other materials may include, but are not limited to, plastic, wood, vinyl, or composite materials. In some embodiments, the material may be any material now know or later developed that can withstand the corrosive effects of pressure treated lumber.

In some embodiments, the material used may be metal and may be made from a cold formed process. Thus, in some embodiments, the shape of the flashing is formed from a single flat sheet that is folded to form the cross-section. In other embodiments, the shapes may be extruded or molded. Those skilled in the art will understand and appreciate the various methods for forming the described shapes based on the various materials described.

The embodiments shown reflect a cross-sectional view of the flashing. Each embodiment may be any length. For example, the embodiment shown in FIG. 1A, may be available in a 10'-0" length, where additional pieces of flashing may be used to accommodate longer runs. To accommodate use of additional pieces, the flashing may be formed to nest with adjacent pieces so as to provide a necessary overlap. As can be seen in FIGS. 1A and 2A, these embodiments readily overlap without additional modification. Also, as shown in FIG. 6A, the top leg 12 of the channel 11 may comprise an outgoing piece 12A and an incoming piece 12B so as to allow an adjacent piece of flashing which is similarly shaped to nest and allow for the necessary overlap. With respect to FIGS. 3A, 4A, and 5A, multiple pieces of these embodiments may be spliced together with butt joints or a small length of the top portion may be coped to allow the remaining portion to overlap. Alternatively, a small length of the back leg 14 and bottom side leg 16 of the channel 11 as well as the attachment flange 18 may be coped to allow for the overlap.

The presently disclosed flashing system provides decking edges and seams with a neat, flush look. Traditionally, edges on exterior decks have been left open to the elements, and the edges have been left unfinished. This system addresses the cosmetic need for providing finished edges on decking.

The method of installing flashing may include erecting deck framing. This framing may include vertical posts, beams, and joists. Where the flashing to be used includes a channel as described above, it is convenient to install the flashing prior to the decking. In this embodiment, the flashing may be installed and secured to a single edge, multiple edges, or the full perimeter of the deck frame with fasteners. At this point, the decking may be installed and may be slid into the channel of the flashing. In some embodiments, the decking may be cut short of the back leg of the channel to accommodate expansion and contraction of the decking material. Additionally, where a single piece of decking is inserted into a channel at each end, the decking may need to be bowed slightly to insert each end into each channel and then flattened and further slid into each channel. Alternatively, one perimeter edge may be left un-flashed to accommodate placement of the decking. This perimeter edge could be an edge perpendicular to the decking pieces or it could be a perimeter edge parallel or even diagonal to the decking pieces. Where a parallel or diagonal edge is left un-flashed, a length of decking could be inserted into the opposing channels from the un-flashed side and slid across the framing to its position and secured. Alternatively, the flashing could be installed after the decking is in place.

The flashing disclosed and described herein is advantageous for several reasons. The flashing provides a channel that receives decking and accommodates the expansion and contraction of decking materials. This allows the deck surface to move without otherwise creating internal stresses that can wear on a deck structure. The flashing system also prevents the intrusion of moisture and debris into seams and gaps in a deck. This buttresses the accommodation of contraction and expansion because, while gaps may be built into a deck to accommodate contraction and expansion, if these gaps fill with debris, they may no longer function as intended. Moreover, to the extent these gaps fill with moisture that cannot escape, the decking materials may deteriorate.

The channel shape included in the embodiments shown herein may allow the flashing to comply with the international code council standards, which may make the flashing code compliant in most or all states within the United States and many locations abroad.

In keeping with concerns related to moisture intrusion, reference is made back to FIGS. 3B and 4B. In the absence of the flashing shown, moisture may build up in the seam between the skirt board 46 and the rim joist or edge joist 28. This moisture may not be able to escape because of the narrow seam between the two pieces, which prevents air from readily flowing through and also allows the surface tension of water to resist the effects of gravity, which would otherwise draw the water out. The flashing shown may prevent moisture from getting into this seam in at least two ways. First, the tee top formed by the skirt flange and the top side leg 12 may prevent moisture and debris from readily entering the seam. Secondly, if moisture were to seep between the top side leg 12 and the decking, this moisture would be redirected by the channel back leg 14 and bottom side leg 16 away from this seam or gap. By preventing moisture from entering this gap, the deck may last longer because moisture deterioration and rotting may be avoided.

An additional moisture issue often develops in an around the ledger board of decks. As with the skirt board problem discussed in the previous paragraph, a ledger board is often fitted tightly to the outside face of a building and if moisture is allowed behind the ledger, it may be unlikely to escape. Conventional L-shaped flashing may extend across the top of the ledger and up the wall a certain distance. However, to the extent that water on the surface of a deck wicks up the wall between the siding and the wall surface, it may then further propagate down behind the ledger. Additionally or alternatively, it may soak into the internal space of the wall, which may lead to mold concerns.

The flashing described herein, and shown in FIG. 6B, includes a side leg 12 of the channel 11 that may extend out over the surface of the decking 30. This side leg 12 may prevent surface water from accessing the seam between the siding and the wall and thus may prevent the wicking and associated moisture problems.

An additional advantage of this top side leg 12 of the channel at the ledger board location relates to its ability to control the siding installation. It is common practice for builders to include a deck ledger on a home for a future deck. In this case, the ledger board may be installed and conventional flashing may be placed along the top surface of the ledger board. When the siding is installed, the siding installer often does not leave enough room above the ledger to accommodate the thickness of the future decking surface materials. When the deck is installed, portions of the siding need to be removed and replaced causing trauma to the exterior waterproofing system of the home.

The top leg of the channel as shown in the embodiment described in FIG. 6B provides a space for receiving future decking surface materials and can further act to prevent the siding installation from intruding this space. In this way, the flashing described herein may be installed at the time the home is built and later trauma to the waterproofing system of the home may be avoided.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

The description of the various embodiments is merely exemplary in nature and, thus, variations that do not depart from the gist of the examples and detailed description herein are intended to be within the scope of the present disclosure. Such variations are not to be regarded as a departure from the spirit and scope of the present disclosure.

What is claimed is:

1. An article of flashing for a deck comprising:

an elongate member configured to prevent water and debris intrusion, the elongate member having a substantially constant cross-section along its length, the cross-section comprising:

a channel with a plurality of substantially uninterrupted legs including a back leg having a first inner edge and a second inner edge, a first side leg connected to the first inner edge and extending to a first outer edge, and a second side leg connected to the second inner edge and extending to a second outer edge, wherein the second side leg comprises an outgoing piece and an incoming piece, the article being configured to nestably overlap with adjacent articles of flashing for an overlap distance; and an attachment flange fixedly connected to the first outer edge, wherein the channel is adapted to receive decking.

2. The article of claim 1, wherein the first inner edge and the second inner edge define a channel height, the channel height being configured to accommodate decking.

3. The article of claim 2, wherein the first side leg is substantially parallel to the second side leg.

4. The article of claim 3, wherein the first and second side legs are substantially perpendicular to the back leg.

5. The article of claim 4, wherein the second inner edge and the second outer edge define a channel depth, the channel depth being configured to accommodate insertion of decking into the channel while maintaining a gap between the decking and the back leg, the gap allowing the decking to expand and contract without interfering with the article of flashing.

6. The article of claim 1, wherein the attachment flange extends in a direction generally away from the channel.

7. The article of claim 6, wherein the attachment flange is oriented substantially parallel to the first side leg.

8. The article of claim 7, further comprising a skirt flange fixedly connected to the channel near the intersection of the back leg and the second side leg.

9. The article of claim 8, further comprising a drip edge fixedly connected to a free edge of the skirt flange.

10. The article of claim 6, wherein the attachment flange is oriented substantially perpendicular to the first side leg.

11. The article of claim 10, further comprising a skirt flange fixedly connected to the channel near the intersection of the back leg and the second side leg.

12. The article of claim 11, wherein the skirt flange extends away from the channel and is oriented substantially parallel to the second side leg.

13. The article of claim 11, further comprising a drip edge fixedly connected to a free edge of the skirt flange.

14. The article of claim 13, wherein the drip edge is substantially perpendicular to the skirt flange and extends in the same direction relative to the skirt flange as the back leg.

15. The article of claim 1, further comprising a siding flange fixedly connected to the channel near the second inner edge.

16. The article of claim 15, wherein the siding flange extends in a direction away from the channel and substantially perpendicular to the second side leg, the siding flange being in substantial alignment with the back leg of the channel.

17. The article of claim 16, wherein the attachment flange is oriented substantially perpendicular to the first side leg.

18. The article of claim 15, wherein the siding flange extends away from the channel and is oriented substantially perpendicular to the second side leg.

19. The article of claim 18, wherein the attachment flange is oriented substantially perpendicular to the first side leg.

20. The article of claim 19, wherein the channel comprises a non-corrosive metal.

21. The article of claim 20, wherein the non-corrosive metal comprises a stainless steel material.

22. The article of claim 19, wherein the channel comprises a vinyl material.

23. The article of claim 19, wherein the channel comprises an aluminum material.

24. The article of claim 19, wherein the channel comprises a galvanized metal material.

25. The article of claim 24, wherein the galvanized metal material includes a G185 galvanization coating.

26. An article of flashing for a deck ledger board secured to a wall and supporting a deck, the deck having decking forming a surface, the article comprising:

an elongate member configured for positioning along the ledger board, a portion of the elongate member adapted for positioning between the ledger board and the decking, the elongate member having a substantially constant cross-section along its length, the cross-section comprising:

a channel comprising a plurality of substantially uninterrupted legs comprising:

a back leg having an upper edge and a lower edge;

a first side leg fixedly connected to and extending from the lower edge in a first direction to a first outer edge, the first side leg being substantially perpendicular to the back leg; and a second side leg fixedly connected to and extending from the upper edge in the first direction to a second outer edge, the second side leg being substantially perpendicular to the back leg and substantially parallel to the first side leg, wherein the second side leg comprises an outgoing piece and an incoming piece;

an attachment flange fixedly connected to and extending from the outer edge of the first side leg in a second direction away from the channel and substantially perpendicular to the first side leg; and a siding flange fixedly connected to and extending from the channel near the upper edge in a third direction opposite the second direction, the siding flange being substantially perpendicular to the second side leg and substantially parallel to and in line with the back leg, wherein:

the upper edge and lower edge define a channel height configured to accommodate insertion of decking into the channel;

the lower edge and the first outer edge define a first distance and the upper edge and the second outer edge define a second distance, the lesser of the first and second distances defining a channel depth configured to accommodate insertion of decking into the channel; and when in place along the ledger board, the siding flange is configured to guide water out of the wall onto the second side leg, the second side leg is configured to guide water passing down the wall out onto the deck surface to prevent water intrusion behind the ledger board and further to guide water passing off of the deck surface into the channel to prevent water from wicking into the wall, the back leg and first side leg together are configured to prevent water passing off of the decking surface from intruding behind the ledger board, and the attachment flange is configured to guide water passing out of the channel away from the decking thereby freeing the water from entrapment.

* * * * *